US007692386B2

(12) United States Patent
Kang et al.

(10) Patent No.: US 7,692,386 B2
(45) Date of Patent: Apr. 6, 2010

(54) PLASMA DISPLAY PANEL

(75) Inventors: Kyoung-Doo Kang, Yongin-si (KR); Won-Ju Yi, Yongin-si (KR)

(73) Assignee: Samsung SDI Co., Ltd., Suwon-si (KR)

( * ) Notice: Subject to any disclaimer, the term of this patent is extended or adjusted under 35 U.S.C. 154(b) by 877 days.

(21) Appl. No.: 11/374,825

(22) Filed: Mar. 13, 2006

(65) Prior Publication Data

US 2006/0232209 A1 Oct. 19, 2006

(30) Foreign Application Priority Data

Mar. 31, 2005 (KR) ..... 10-2005-0026869

(51) Int. Cl.
*H01J 17/49* (2006.01)

(52) U.S. Cl. ..... 313/584; 313/582

(58) Field of Classification Search ..... 313/584, 313/582

See application file for complete search history.

(56) References Cited

U.S. PATENT DOCUMENTS

| | | | | |
|---|---|---|---|---|
| 5,744,909 | A * | 4/1998 | Amano | 313/585 |
| 2002/0130620 | A1 | 9/2002 | Jeong et al. | |
| 2005/0225241 | A1 * | 10/2005 | Woo et al. | 313/582 |

FOREIGN PATENT DOCUMENTS

| | | | |
|---|---|---|---|
| CN | 1380676 | A | 11/2002 |
| CN | 1388556 | A | 1/2003 |
| JP | 2000-133144 | | 5/2000 |
| JP | 2004-235042 | | 8/2004 |
| KR | 10-2005-0009385 | | 1/2005 |

OTHER PUBLICATIONS

KR2001075758A*
English Translation of KR2001075758A.*
Patent Abstracts of Japan, for Publication No. 2004-235042; Date of Publication of Application Aug. 19, 2004 in the name of Susumu Sakamoto, et al.
Korean Patent Abstracts, for Publication No. 1020050009385 A; Date of Publication of Application Jan. 25, 2005 in the name of Hidekazu Hatanaka, et al.

* cited by examiner

*Primary Examiner*—Nimeshkumar D Patel
*Assistant Examiner*—Mary Ellen Bowman
(74) *Attorney, Agent, or Firm*—Christie, Parker & Hale, LLP

(57) ABSTRACT

In a plasma display panel first and second substrates are located apart and substantially parallel to each other. A barrier rib layer is located between the first substrate and the second substrate. Discharge cells having various cross-sectional areas are formed within the barrier rib layer. Phosphor layers are formed within the discharge cells. Ring shaped first and second electrodes, conforming to the cross-sectional area of the discharge cells, surround the discharge cells adjacent to one or the other of the first and second substrates. The first electrodes are coupled together along a first direction and the second electrodes are coupled together along the same first direction. Address electrodes extend in a direction crossing the first direction and include protruding portions conforming to inner contours of the discharge cells.

15 Claims, 8 Drawing Sheets

PLASMA DISPLAY PANEL

CROSS-REFERENCE TO RELATED APPLICATION

This application claims priority to and the benefit of Korean Patent Application No. 10-2005-0026869 filed in the Korean Intellectual Property Office on Mar. 31, 2005, the entire content of which is incorporated herein by reference.

BACKGROUND OF THE INVENTION (a) Field of the Invention

The present invention relates to a Plasma Display Panel (PDP). More particularly, the present invention relates to a PDP in which an address discharge can be stabilized and reactive power consumption caused by capacitance between neighboring address electrodes can be reduced.

(b) Description of the Related Art

A three-electrode surface-discharge type of display is one exemplary structure for a PDP. The three-electrode surface-discharge type of PDP includes sustain electrodes, scan electrodes, and address electrodes. The sustain electrodes and the scan electrodes are located in parallel on the same plane of a front substrate. The address electrodes are provided on a rear substrate in a direction crossing the direction of the sustain electrodes and the scan electrodes.

Barrier ribs are provided between the front substrate and the rear substrate, both between the sustain electrodes and the scan electrodes and between the sustain electrodes and the address electrodes. Discharge cells are formed by the barrier ribs where the sustain electrodes and the scan electrodes, that are located in parallel, cross the address electrodes. The discharge cells are filled with a discharge gas.

The PDP selects a turn-on discharge cell through an address discharge by a scan pulse applied to the scan electrodes and an address pulse applied to the address electrodes, and implements images through a sustain discharge by a sustain pulse alternately applied to sustain electrodes and scan electrodes of the selected turn-on discharge cells.

The sustain electrodes and the scan electrodes of the PDP are provided near the front of a discharge space. The PDP generates a plasma discharge between inner surfaces of the sustain electrodes and the scan electrodes and diffuses the plasma discharge toward the rear substrate. The plasma discharge excites phosphors within the discharge cells to generate visible rays that form an image.

The sustain electrodes and the scan electrodes provided at the front substrate reduce the aperture ratio of the discharge cells and lower the transmittance of the visible rays, which are generated within the discharge cells and directed toward the front substrate.

Therefore, the three-electrode surface-discharge type of PDP has low brightness and low luminous efficiency. If the PDP is used for a long period, an electric field causes charged particles of the discharge gas to generate ion sputtering in the phosphors. The ion sputtering in the phosphors may result in permanent after-images.

As an attempt to eliminate the generation of the permanent after-images, a recently developed PDP is configured such that the sustain electrodes and the scan electrodes encompass the lateral sides of the discharge cells, and the address electrodes are provided on the rear substrate. As a result, the aperture ratio of the discharge cells can be increased, and the transmittance of the visible rays can be improved.

However, this recently developed PDP may still have a limitation in that a discharge between the scan electrodes and the address electrodes is not stable because a distance between the scan electrode and the address electrode within one discharge cell is not uniform throughout the entire length of the scan electrodes.

The above information disclosed in this Background section is only for enhancement of understanding of the background of the invention and therefore it may contain information that does not form the prior art that is already known in this country to a person of ordinary skill in the art.

SUMMARY OF THE INVENTION

The present invention provides a PDP having features of a stabilized address discharge between scan electrodes and address electrodes, and reduced reactive power consumption caused by capacitance between the neighboring address electrodes.

An exemplary plasma display panel according to an embodiment of the present invention includes a first substrate and a second substrate, a barrier rib layer, phosphor layers, first electrodes, second electrodes, and address electrodes. The first substrate and the second substrate are located substantially parallel to each other with a distance in between the two. The barrier rib layer is located between the first substrate and the second substrate and forms discharge cells. The phosphor layers are formed within the discharge cells. The first electrodes encompass, circumscribe, surround, or encircle the discharge cells between the first substrate and the second substrate, adjacent to either the first substrate or the second substrate, and are coupled along a first direction. The second electrodes are located apart from the first electrodes along a direction vertical to the respective planes of the first substrate and the second substrate, and are also coupled along the first direction. The second electrodes also encompass, circumscribe, surround, or encircle the discharge cells adjacent to the other one of the first substrate and the second substrate that is not adjacent the first electrodes. The address electrodes are located apart from the second electrodes in the vertical direction, and extend in a direction crossing the direction of the second electrodes or the first direction. The address electrodes include protruding portions formed corresponding to the second electrodes.

The protruding portions of the address electrodes may be formed along inner surfaces of the discharge cells. Outer contours of the protruding portions may be located inside of the inner surfaces of the discharge cells.

The first electrodes and the second electrodes may be formed in an elliptical shape surrounding their respective discharge cells. Then, the protruding portions of the address electrodes may be formed in the shape of an elliptical plate that fits within the walls of the discharge cells that substantially have the same elliptical cross-sectional area.

The first electrodes and the second electrodes may be formed in a circular shape surrounding their respective discharge cells at both top and bottom sides of cylindrically formed discharge cells. The protruding portions of the address electrodes may be formed in a circular plate shape that has the substantially same shape as the inner cross-sectional surfaces of the corresponding discharge cells.

The first electrodes and the second electrodes may be formed in overlapping polygonal shapes encompassing their respective discharge cells. Then, the protruding portions of the address electrodes may be formed in a polygonal plate shape that has the substantially same shape as the inner cross-sectional surfaces of the corresponding discharge cells.

The first electrodes and the second electrodes can include a metallic material with good electrical conductivity. The first electrodes and the second electrodes may be covered with a dielectric layer forming an insulation structure. The dielectric layer, over the inner surfaces of the discharge cells, may be covered with protective layers.

The address electrodes are located over the first substrate, and the barrier rib layer is located over the address electrodes. The first electrodes and the second electrodes are located between the barrier rib layer and the second substrate.

The discharge cells may have a cross-sectional area, corresponding to the shape of the first electrodes and the second electrodes, that is circular, elliptical, or shaped as a polygon.

DETAILED DESCRIPTION OF THE EMBODIMENTS

Figure 1:
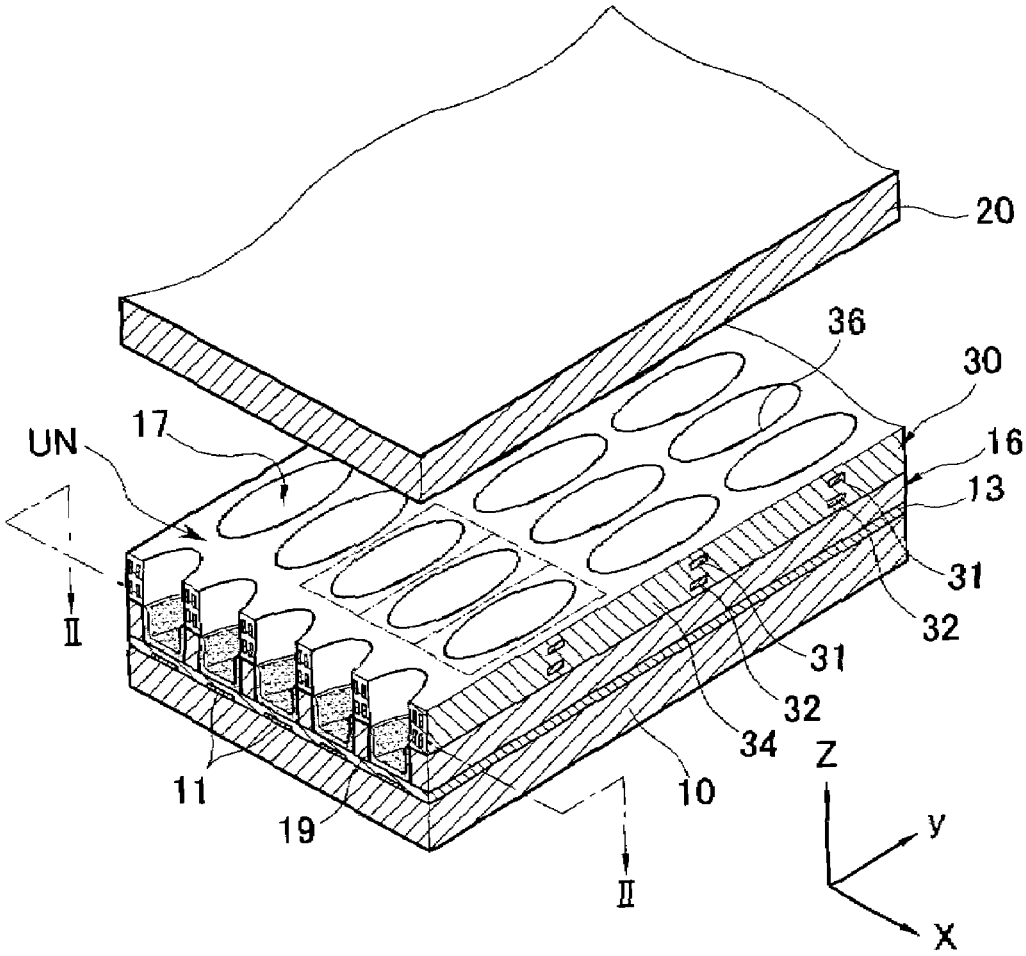
FIG. 1 is an exploded perspective view of a PDP according to a first exemplary embodiment of the present invention.

When a PDP is mounted on a wall, the x-y plane of the drawings of this application would usually stand vertically while the z-axis of the drawings would fall along the horizontal direction. However, for ease of description, the x-y planes marked in the drawings are also referred to as the horizontal planes and the z-axis direction marked in the drawings is also referred to as the vertical direction.

With reference to FIGS. 1, 2, 3, and 4, the PDP of the first embodiment includes a first substrate 10 (hereinafter referred to as "rear substrate") and a second substrate 20 (hereinafter referred to as "front substrate"), which are located substantially parallel to each other with a distance in between. A barrier rib layer 16 is located between the rear substrate 10 and the front substrate 20.

The barrier rib layer 16 partitions the space between the rear substrate 10 and the front substrate 20 into a plurality of discharge cells 17. The barrier rib layer 16 may be formed over the rear substrate 10, as in the exemplary embodiment shown, or it may be formed over the front substrate 20 (not shown). Also, although not illustrated, the barrier rib layer 16 can be either separated from or integrally formed over the rear and front substrates 10, 20.

The barrier rib layer 16 can form the discharge cells 17 in various shapes. The discharge cells 17 of the first exemplary embodiment are formed with an elliptical cross-section in the plane of the rear substrate 10 and the front substrate 20 (e.g., the x-y plane of FIG. 2). The discharge cells 17 are circumscribed or surrounded by walls that are vertical to the plane of the rear and front substrates 10, 20 and thus extend along the z-axis direction in FIGS. 1 through 4. The elliptically-shaped cross-section of the discharge cells 17 has a long axis $L_1$ and a short axis $L_2$. Thus, various points on the discharge cell inner walls are located at different distances from a vertical center line of the discharge cell 17.

The discharge cells 17 are filled with a discharge gas, for example a mixture of neon (Ne) and xenon (Xe), for generating vacuum ultraviolet (VUV) rays through a plasma discharge and include phosphor layers 19 for absorbing the VUV rays and emitting visible light.

Figure 3:
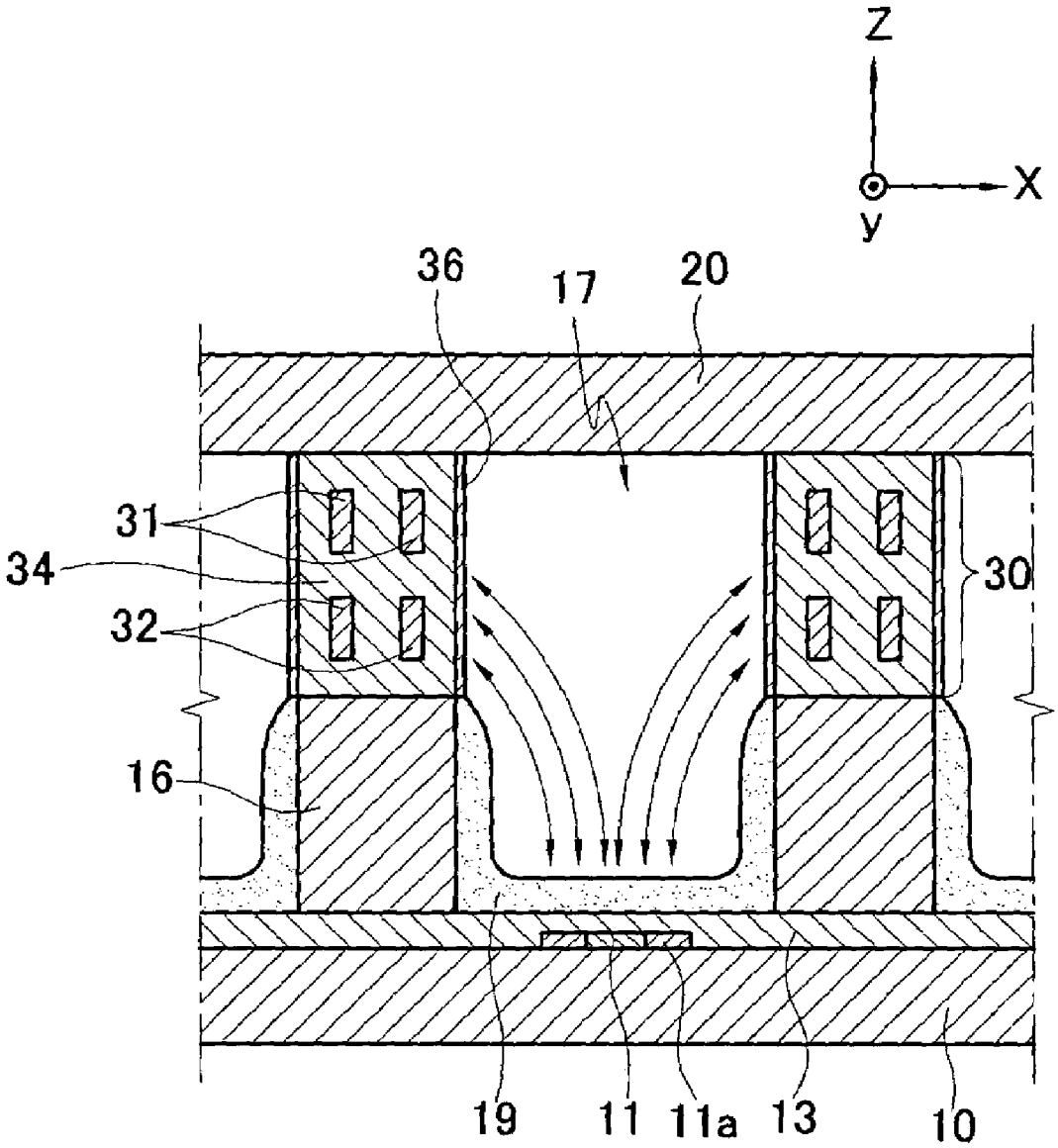
FIG. 3 is a cross-sectional view of the PDP taken along the line III-III illustrated in FIG. 2.

The phosphor layers 19 can be formed over the inner surfaces of the discharge cells 17 configured by the barrier rib layer 16 and over one or both surfaces of the front substrate 20 and the rear substrate 10, which also form the discharge cells 17. When, as illustrated in FIGS. 1 and 3, the phosphor layers 19 are formed over the rear substrate 10, the phosphor layers 19 are formed from a reflective material that absorbs the VUV rays at the inner surfaces of the discharge cells 17 and reflects visible rays toward the front substrate 20.

In addition, although not illustrated, when the phosphor layers 19 are formed over the front substrate 20, the phosphor layers 19 are formed from a transmissive material that absorbs the VUV rays at the inner surfaces of the discharge cells 17 and transmits visible rays. The phosphor layers 19 can also be formed over both of the rear and front substrates 10, 20.

Figure 2:
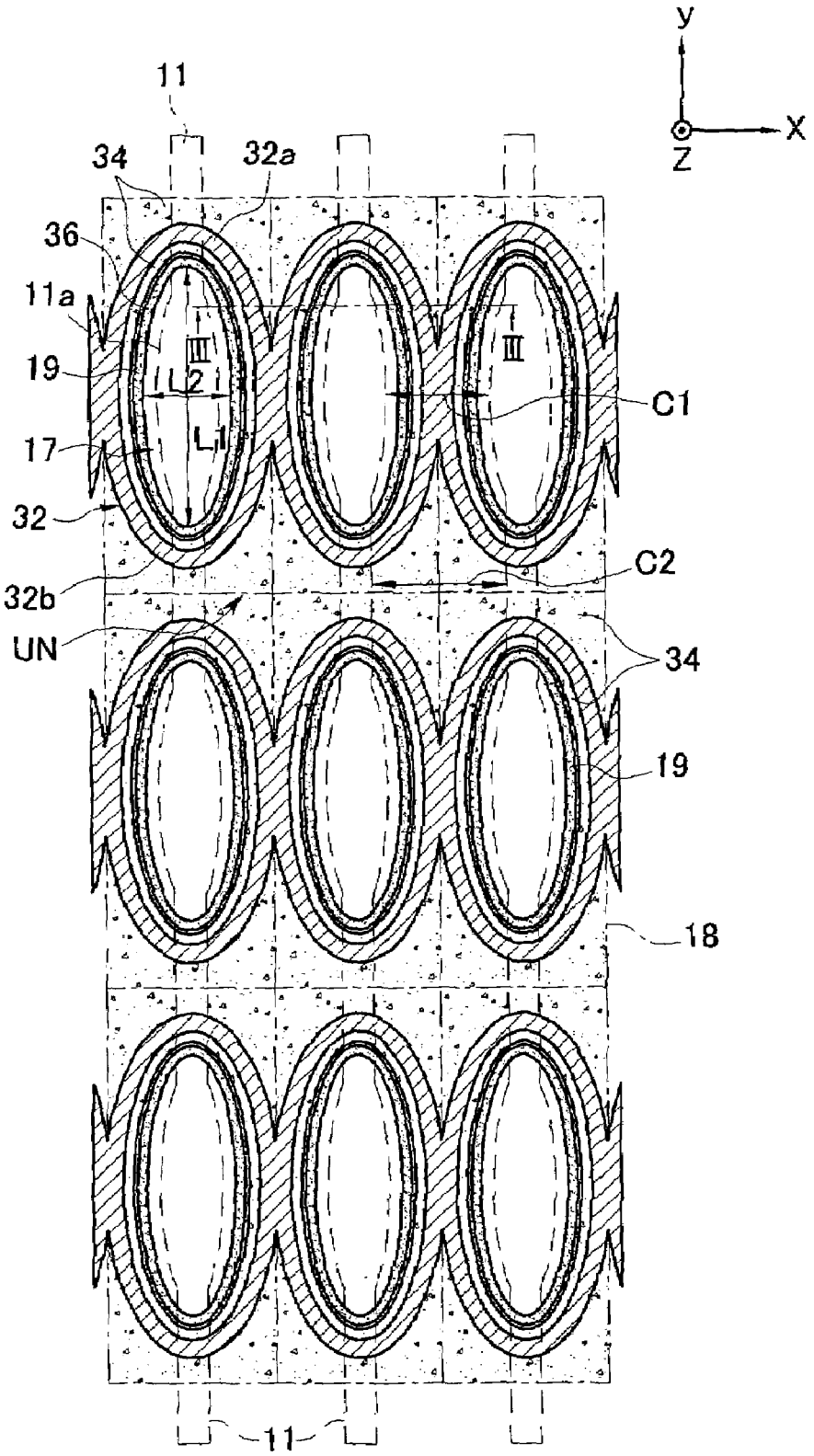
FIG. 2 is a cross-sectional view of the PDP taken along the line II-II illustrated in FIG. 1.
Figure 4:
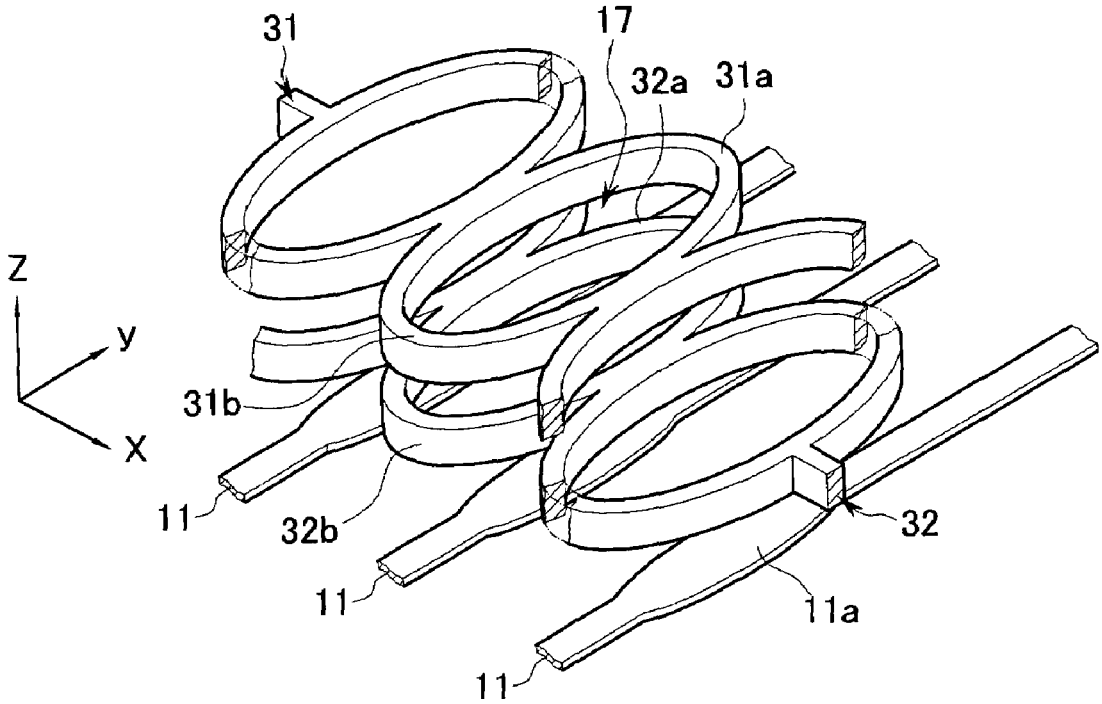
FIG. 4 is a perspective view illustrating an electrode structure of the PDP according to the first exemplary embodiment of the present invention.

The PDP of the first exemplary embodiment includes address electrodes 11, first electrodes 31 (hereinafter referred to as "sustain electrodes"), and second electrodes 32 (hereinafter referred to as "scan electrodes") that are located between the rear substrate 10 and the front substrate 20. The address electrodes 11 correspond to the discharge cells 17. The sustain electrodes 31 circumscribe the discharge cells 17 along a portion of the walls of the discharge cells 17 in a direction (e.g., the z-axis direction) vertical to the planes of the rear and front substrates 10, 20. As shown in FIGS. 2, 3, and 4, the sustain electrodes 31 circumscribing or surrounding the different discharge cells 17 are coupled together along a first direction (e.g., the x-axis direction). The scan electrodes 32 also surround the discharge cells 17 along another portion of the vertical walls of the discharge cells 17. The scan electrodes 32 are located apart from the sustain electrodes 31 and the address electrodes 11 along the vertical direction (i.e., the z-axis direction). The scan electrodes 32 are also coupled together along the first direction (i.e., the x-axis direction). As illustrated, the sustain electrodes 31 and the scan electrodes 32 may be formed in a separate electrode layer 30 and can be located between the rear substrate 10 and the front substrate 20.

Although not illustrated, the address electrodes 11 can be formed in an electrode layer similar to the sustain electrodes 31 and the scan electrodes 32, and can be located between the rear substrate 10 and the front substrate 20. As shown, the address electrodes 11 may be formed over the rear substrate 10. Although not illustrated, the address electrodes 11 may be formed on the front substrate 20.

In the first exemplary embodiment, the address electrodes 11 are formed over the rear substrate 10, and the barrier rib layer 16 is also formed over the rear substrate 10. The sustain electrodes 31 and the scan electrodes 32 are formed in the separate electrode layer 30, which is located between the front substrate 20 and the barrier rib layer 16. Although not illustrated, the sustain electrodes 31 and the scan electrodes 32 can be formed directly on the barrier rib layer 16. In that case, the electrode layer 30 serves an additional role as the barrier rib layer 16, which forms the discharge cells 17.

As illustrated in the first exemplary embodiment, each of the address electrodes 11 extend along a second direction (e.g., the y-axis), and thus each one of the address electrodes 11 corresponds to the row of discharge cells 17 that are adjacent to one another along the y-axis direction. A plurality of the address electrodes 11 are arranged in parallel and separated with a certain distance. Each two neighboring address electrodes 11, then correspond to the discharge cells 17 that are adjacent along the first direction (i.e., the x-axis direction).

The address electrodes 11 include protruding portions 11*a*. The protruding portions 11*a* protrude from their respective address electrodes 11 generally in the x-axis direction. Also, the protruding portions 11*a* are formed such that their outer contours, in a horizontal cross-sectional view, is substantially close to an inner contour of the horizontal cross-section of the scan electrodes 32 that encompass the discharge cells 17. That is, in a horizontal cross-section shown in FIG. 2, each of the protruding portions 11*a* is located in the center of an individual discharge cell 17 that is in turn surrounded by its corresponding scan electrode 32. Along a vertical cross-section shown in FIG. 3, the protruding portion 11*a* is on the side of the rear substrate 10. The protruding portions 11*a* are formed following the inner surfaces of the walls of the discharge cells 17. In other words, outer edges or outer contours of the protruding portions 11*a* have substantially the same shape as the inner contours of the vertical walls of the discharge cells 17. The outer contours of the individual protruding portions 11*a* are located inside their corresponding discharge cells 17. Thus the protruding portions 11*a* can generate an address discharge within the scan electrodes 32 circumscribing the discharge cells 17. This address discharge generation is illustrated in FIG. 3.

The protruding portions 11*a* increase the area between the address electrodes 11 and their corresponding scan electrodes 32. Hence, address discharge can be generated even with a low voltage difference, and a more stable address discharge can be obtained.

Referring to FIG. 2, the protruding portions 11*a* of two adjacent address electrodes 11 reduce a distance C1 between the adjacent address electrodes 11 in regions corresponding to the discharge cells 17. However, the adjacent address electrodes 11 are spaced further apart in non-discharge (UN) regions defined outside the discharge cells 17. A distance C2 between two adjacent address electrodes 11 in the non-discharge region UN is therefore greater than the aforementioned narrow distance C1 between the protruding portions 11*a*. Hence, the overall capacitance between the adjacent address electrodes 11 is controlled, and reactive power consumption caused by this capacitance can also be reduced.

The address electrodes 11 including the protruding portions 11*a* are formed over the inner surface of the rear substrate 10, and can be covered with a dielectric layer 13. The dielectric layer 13 reduces direct collisions of positive ions or electrons with the address electrodes 11 during the discharge, so that damage to the address electrodes 11 can be reduced. The dielectric layer 13 includes a dielectric material that can generate and store wall charges. In the case that the dielectric layer 13 is provided, the phosphor layers 19 are formed over the inner surfaces of the walls of the discharge cells 17 and over the surface of the dielectric layer 13 formed inside the discharge cells 17 over the rear substrate 10.

As illustrated in FIG. 3, when the address electrodes 11 are formed over the rear substrate 10 that need not transmit visible rays, the address electrodes 11 can include a metallic material with good electrical conductivity.

The address electrodes 11 extend in a direction crossing the direction of the scan electrodes 32 and the sustain electrodes 31. This arrangement permits addressing a discharge cell by an address pulse applied to the address electrode 11 and a scan pulse applied to the scan electrode 32 whose directions cross at the discharge cell being addressed. As shown and described above, only the directions of the electrodes cross while the address electrodes 11 are located apart from the sustain electrodes 31 and the scan electrodes 32 in the vertical direction (i.e., the z-axis direction) with respect to the rear substrate 10 and the front substrate 20.

The sustain electrodes 31 and the scan electrodes 32 form images by generating a sustain discharge using a sustain pulse alternately applied at the selected discharge cell 17 through the address discharge. For the formation of the images, the sustain electrodes 31 and the scan electrodes 32 are located apart from each other within the electrode layer 30 in the vertical direction (i.e., the z-axis direction) with respect to the rear substrate 10 and the front substrate 20. The sustain electrodes 31 and the scan electrodes 32 can be formed to have a symmetrical structure.

The address electrodes 11, the sustain electrodes 31, and the scan electrodes 32 can serve different roles according to voltage signals applied to each electrode.

In the first exemplary embodiment, the address electrodes 11 are provided on the rear substrate 10, and the barrier rib layer 16 is located over the rear substrate 10 above the address electrodes 11. The sustain electrodes 31 and the scan electrodes 32 are formed in the electrode layer 30, which is located between the barrier rib layer 16 and the front substrate 20. Within the electrode layer 30, the sustain electrodes 31 are located closer to the front substrate 20 side, whereas the scan electrodes 32 are closer to the barrier rib layer 16 side and therefore closer to the address electrodes 11. As a result, a shorter discharge gap exists between the scan electrodes 32 and the address electrodes 11, and thus an address discharge can be generated using a low voltage difference.

The sustain electrodes 31 are formed between the rear substrate 10 and the front substrate 20 to each circumscribe their respective discharge cell 17 over a portion of the vertical wall of their respective discharge cell 17.

The scan electrodes 32 are located at a vertical distance from the sustain electrodes 31, and are also formed between the rear substrate 10 and the front substrate 20 to each circumscribe their respective discharge cell 17 over another portion of the vertical wall of their respective discharge cell 17.

The sustain electrodes 31 and the scan electrodes 32 are each formed to have a cross-sectional area in the horizontal x-y plane that is symmetrical about the vertical z-axis. Moreover, the cross-sections of the sustain and scan electrodes 31, 32 in the horizontal plane overlap each other while the electrodes 31, 32 are apart in the vertical direction. Therefore, a sustain discharge generated between the sustain electrodes 31 and the scan electrodes 32 is directed in the vertical direction (i.e., the z-axis direction) within the discharge cells 17. This particular direction of the sustain discharge causes an electric field generated by a voltage signal applied to the sustain electrodes 31 and the scan electrodes 32 to be concentrated between the two electrodes 31, 32.

As a result, luminous efficiency can be improved, and ions generated in the case of a prolonged discharge do not collide with the phosphor layers 19 due to the electric field between the sustain and scan electrodes 31, 32. Therefore, damage to the phosphor layers 19 caused by ion sputtering can be reduced.

Because the sustain electrodes 31 and the scan electrodes 32 are formed all around the discharge cells 17, the sustain discharge generated in the vertical direction within the discharge cells 17 can be substantially uniform or at least symmetrical.

Because the sustain electrodes 31 and the scan electrodes 32 circumscribing each elliptical discharge cell 17 have overlapping cross-sections in the horizontal x-y plane, they do not reduce the discharge cell cross-sectional area. At the same time, because these electrodes 31, 32 are located one on top of the other, they increase the depth of the discharge cell along the vertical z-axis direction, thus increasing the internal space of the discharge cell 17. Increasing the internal spaces of the discharge cells 17, helps increase the area of the phosphor layers 19 in a fine pitch display in which the discharge cells 17 are formed with limited cross-sectional areas in the horizontal plane. As a result, a stable discharge is induced, thereby increasing a discharge amount of the VUV rays.

The sustain electrodes 31 and the scan electrodes 32 formed around the discharge cells 17 can be formed in various shapes. The sustain electrodes 31 and the scan electrodes 32 illustrated in the first exemplary embodiment are formed as rings having an elliptical shape, corresponding to the elliptical cross-section of the discharge cells 17. The protruding portions 11*a* of the address electrodes 11 can be formed in the shape of an elliptical plate whose outer contour substantially follows the inner contour of the discharge cells 17.

Portions 31*a*, 31*b* of the sustain electrodes 31 located near the two ends of the long axis L1 of the ellipse, that extends in the y-axis direction, will be referred to as long axial portions 31*a*, 31*b*. The long axial portions 31*a*, 31*b* are located opposite each other. Portions of the walls of the respective discharge cells 17 between the long axial portions 31*a*, 31*b* form the sides of the respective discharge cells 17. By increasing the length of the long axis $L_1$ with respect to the short axis $L_2$, the discharge cells 17 are elongated in the y-axis direction. As a result, the areas of the discharge cells 17 encompassed by the sustain electrodes 31 are increased.

Long axial portions 32*a*, 32*b* of the scan electrodes 32 are located next to a portion of the walls of their respective discharge cells 17 near the two ends of the long axis L1 of the ellipse. Therefore, the long axial portions 32*a*, 32*b* are located opposite each other and the remaining portions of the scan electrodes 32 between the long axial portions 32*a*, 32*b* are located next to the sides of their respective discharge cell walls. As the long axis $L_1$ is elongated with respect to the short axis $L_2$, the discharge cells 17 are elongated in the y-axis direction. As a result, the areas of the discharge cells 17 encompassed by the scan electrodes 32 are increased.

The sustain electrodes 31 and the scan electrodes 32 are provided at the lateral sides or the walls of the discharge cells 17 along with the separate electrode layer 30. With this arrangement, the sustain electrodes 31 and the scan electrodes 32 do not block the visible rays. The sustain electrodes 31 and the scan electrodes 32 can therefore include a metallic material that has good electrical conductivity but is opaque to light.

The sustain electrodes 31 and the scan electrodes 32 are covered with a dielectric layer 34, thereby forming a mutual insulation structure. The sustain electrodes 31, the scan electrodes 32, and the dielectric layer 34 that covers the sustain electrodes and the scan electrodes 32, together form the electrode layer 30. The dielectric layer 34 stores wall charges during the discharge and also provides insulation for the sustain electrodes 31 and the scan electrodes 32. The dielectric layer 34 formed over outer surfaces of the sustain electrodes 31 and the scan electrodes 32 can form cylindrical discharge cells 17 corresponding to the structure of the barrier rib layer 16.

Because the dielectric layer 34 and the barrier rib layer 16 form the walls of the discharge cells 17, the dielectric layer 34 can be covered with protective layers 36 over the inner surfaces of the discharge cells 17. Particularly, the protective layers 36 can be formed over the portions of inner walls of discharge cells 17 that are exposed to plasma discharge. Although the protective layers 36 protect the dielectric layer 34 and require a secondary electron emission coefficient, the protective layer 36 does not need to be transparent to visible rays. In other words, the sustain electrodes 31 and the scan electrodes 32 are formed between the front substrate 20 and the rear substrate 10 as opposed to being formed over the front substrate 20. Therefore, the protective layers 36 formed over the dielectric layer 34, which covers the sustain electrodes 31 and the scan electrodes 32, can include a material that is not transparent to the visible rays. As an example of the protective layer 36, magnesium oxide (MgO) that is non-transparent with respect to visible rays has a higher secondary electron emission coefficient than the type of MgO that is transparent with respect to the visible rays. Thus, the non-transparent MgO can decrease a discharge firing voltage level to a greater extent.

Hereinafter, various other exemplary embodiments of the invention will be described. Detailed description of features of the second and third exemplary embodiments that are similar to or substantially the same as the features of the first exemplary embodiment, will be omitted, and the following description will be mainly focused on the differences between the embodiments.

Figure 5:
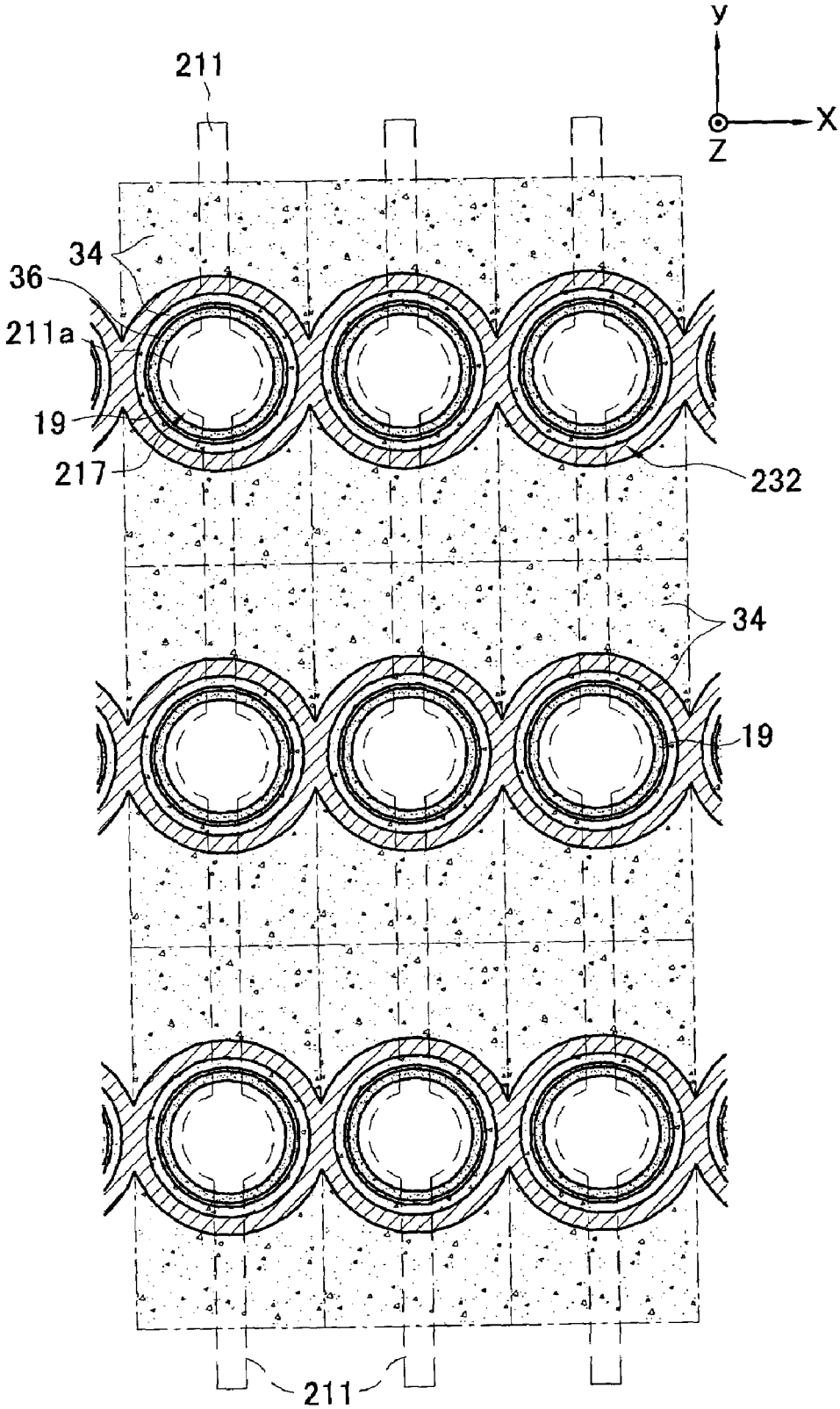
FIG. 5 is a cross-sectional view of a PDP according to a second exemplary embodiment of the present invention.
Figure 6:
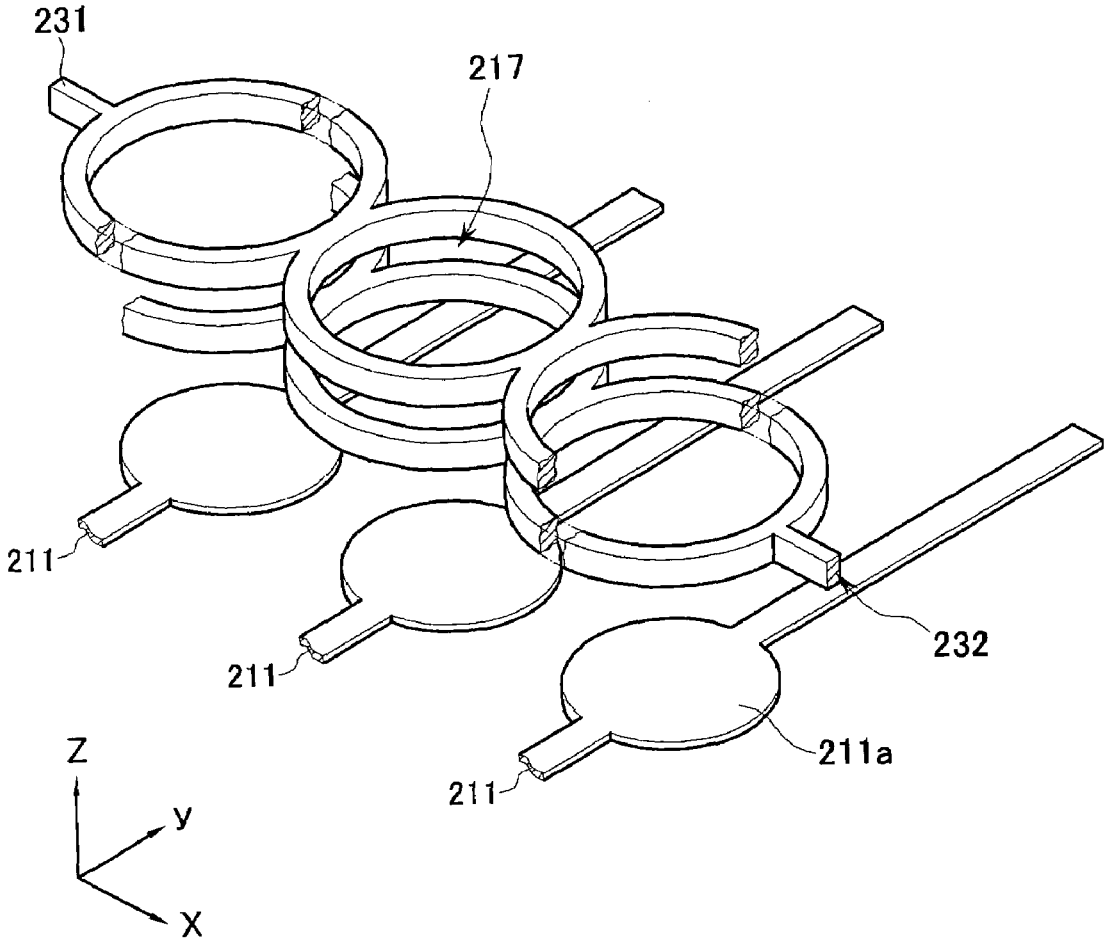
FIG. 6 is a perspective view illustrating an electrode structure of the PDP according to the second exemplary embodiment of the present invention.

FIG. 5 is a cross-sectional view of a PDP according to the second exemplary embodiment of the present invention. FIG. 6 is a perspective view illustrating an electrode structure of the PDP of the second exemplary embodiment of the present invention.

Compared with the first embodiment, a sustain discharge can diffuse more uniformly in the second exemplary embodiment. To obtain more uniform diffusion of the sustain discharge, discharge cells 217 are formed in a cylindrical shape with a circular cross-section, and sustain electrodes 231 and scan electrodes 232 are formed as circular rings around the walls of the cylindrical discharge cells 217. For this embodiment, protruding portions 211*a* of address electrodes 211 can be formed in the shape of a circular plate having an outer contour substantially following the inner contour of the discharge cells 217 in the horizontal xy plane.

Figure 7:
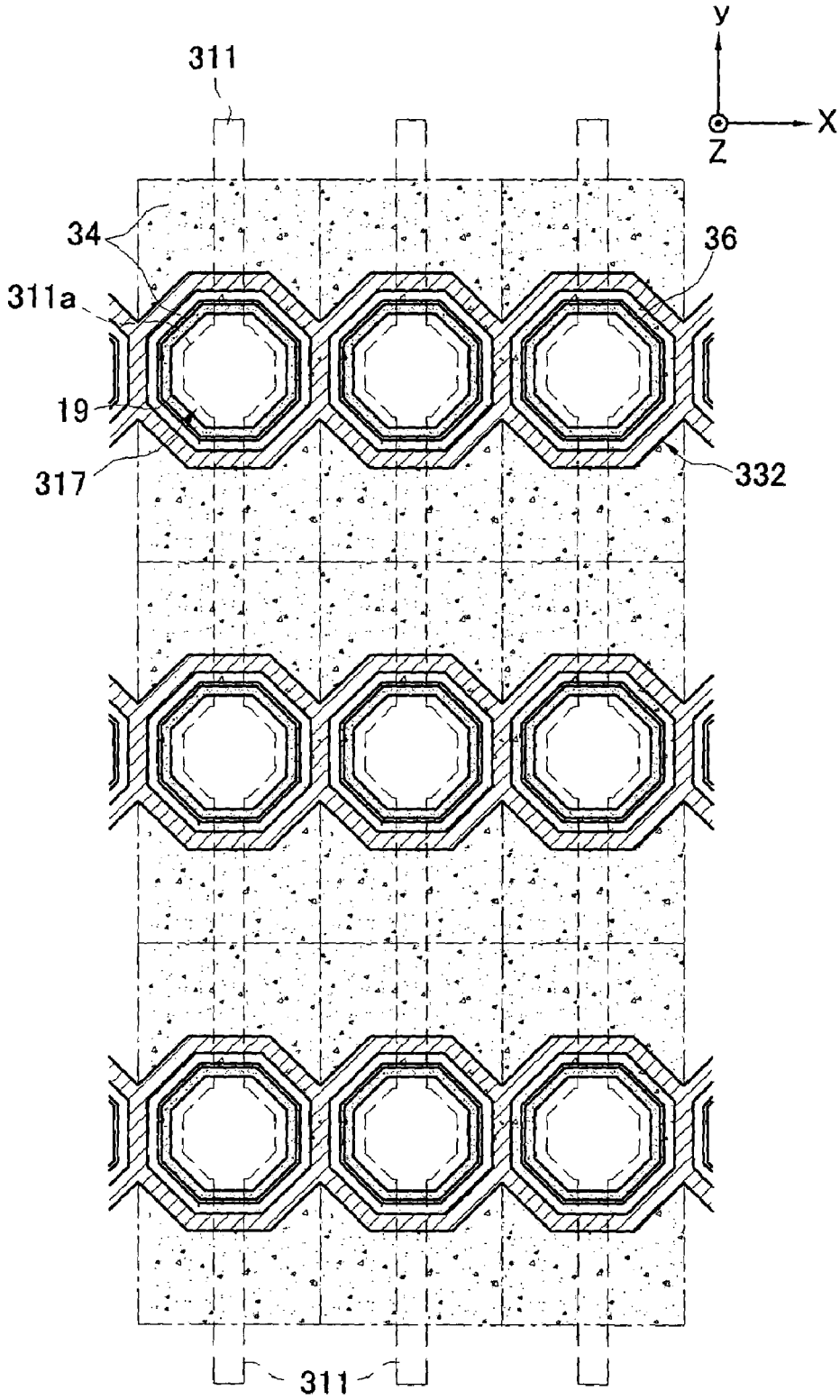
FIG. 7 is a cross-sectional view of a PDP according to a third exemplary embodiment of the present invention.
Figure 8:
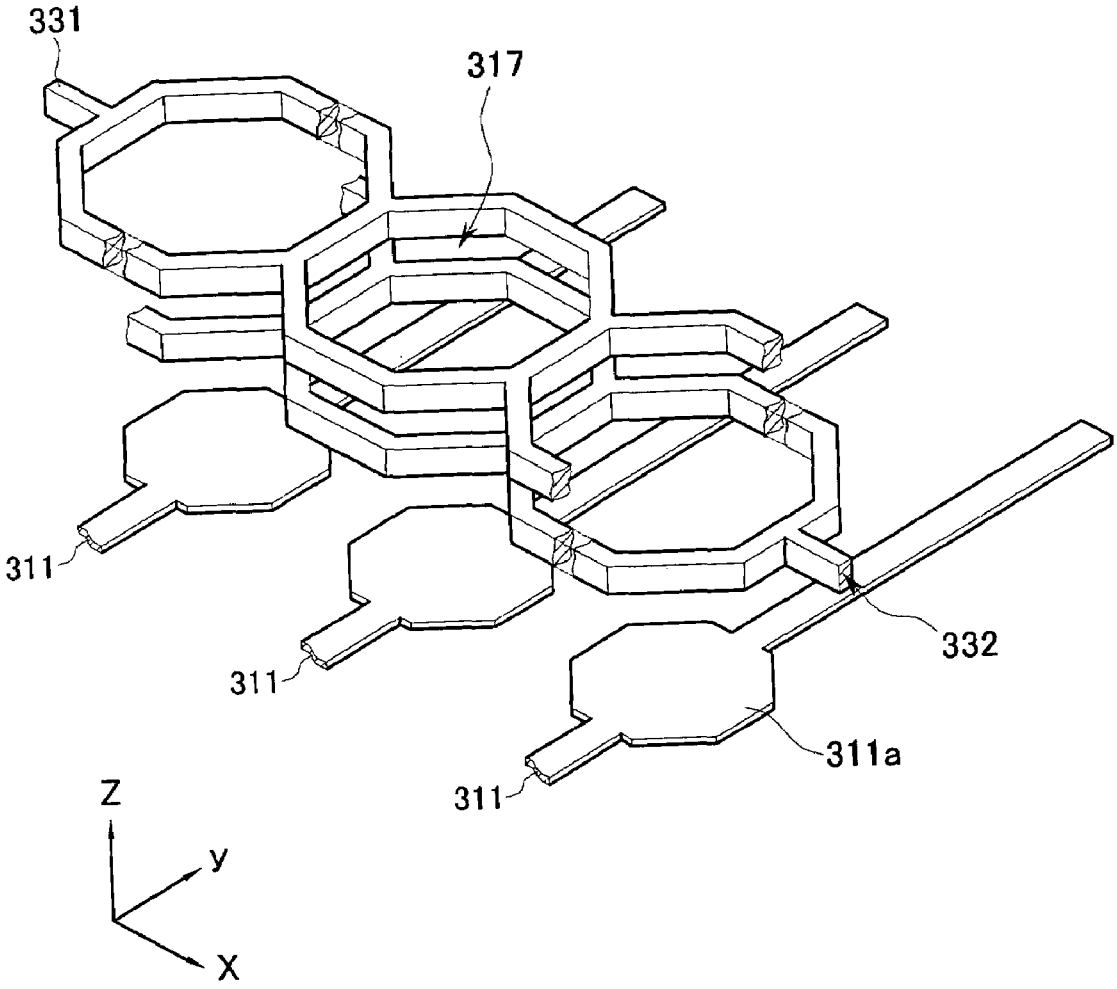
FIG. 8 is a perspective view illustrating an electrode structure of the PDP according to the third exemplary embodiment of the present invention.

FIG. 7 is a cross-sectional view of a PDP according to the third exemplary embodiment of the present invention. FIG. 8 is a perspective view illustrating an electrode structure of the PDP according to the third exemplary embodiment of the present invention.

Compared with the first and second exemplary embodiments, the third exemplary embodiment has a sustain discharge that can diffuse at a medium level. For this medium diffusion level of the sustain discharge, discharge cells 317 are formed in a polygonal shape, and sustain electrodes 331 and scan electrodes 332 are formed as rings of a polygonal shape circumscribing the walls of the polygonal discharge cells 317. For this embodiment, protruding portions 311*a* of the address electrodes 311 can be formed in the shape of a polygonal plate having an outer contour substantially following the inner contour of the inner surfaces of the walls of the discharge cells 317. Particularly, FIG. 7 illustrates the protruding portions 311*a* formed with an octagonal shape in the xy plane.

As described above, the PDP according to the exemplary embodiments of the present invention includes the sustain electrodes and the scan electrodes, which are located between the rear substrate and the front substrate and are stacked one over the other in the direction vertical with respect to the planes of the rear and front substrates that are considered horizontal for convenience of description. Arranged as such, the sustain and scan electrodes correspond to the lateral side walls of the discharge cells. As a result, the aperture ratio of the discharge cells is not reduced and the transmittance of visible rays is not being blocked by the sustain and scan electrodes.

Also, in the PDP according to the exemplary embodiments of the present invention, the sustain electrodes are located closer to one end of their respective discharge cells, and the scan electrodes are located closer to the other end of their respective discharge cells having a distance apart from the sustain electrodes. The address electrodes and the scan electrodes may be located alternately. The address electrodes have the protruding portions, which are surrounded by the discharge cells. The protruding portions increase the area in which the scan electrodes correspond to the address electrodes, and thus stabilize an address discharge between the scan electrodes and the address electrodes. However, the protruding portions are not formed at non-discharge regions, and thus a relatively large distance is maintained between adjacent address electrodes in the non-discharge regions. As a result, capacitance between two adjacent address electrodes in the non-discharge regions is not affected by the protruding portions. Lower capacitance can keep reactive power consumption low.

While exemplary embodiments of this invention have been shown and described, it is to be understood that the invention is not limited to the disclosed embodiments, rather, it is intended to cover various modifications and equivalent arrangements included within the spirit and scope of the appended claims and their equivalents.

What is claimed is:

1. A plasma display panel comprising:

a first substrate and a second substrate substantially parallel to each other with a distance therebetween;

a barrier rib layer between the first substrate and the second substrate;

discharge cells between the first substrate, the second substrate, and within the barrier rib layer;

a phosphor layer within each of the discharge cells;

first electrodes between the first substrate and the second substrate and coupled together at a plurality of first electrode single junctions between the first electrodes along a first direction, each of the first electrodes circumscribing one of the discharge cells, each of the first electrode single junctions having an outer portion that converges toward its center;

second electrodes between the first substrate and the second substrate and apart from the first electrodes along a direction substantially perpendicular to the first substrate and the second substrate and coupled together at a plurality of second electrode single junctions between the second electrodes along the first direction, each of the second electrodes circumscribing one of the discharge cells, each of the second electrode single junctions having an outer portion that converges toward its center; and address electrodes apart from the second electrodes along a direction substantially perpendicular to the first substrate and the second substrate and extending in a direction crossing the first direction, wherein each of the address electrodes includes a protruding portion, the protruding portion having an outer contour within an inner contour of the second electrodes.

2. The plasma display panel of claim 1, wherein the protruding portion corresponds to an inner surface of a corresponding one of the discharge cells.

3. The plasma display panel of claim 2, wherein the protruding portion is within a periphery of a corresponding one of the discharge cells.

4. A plasma display panel comprising:

a first substrate and a second substrate substantially parallel to each other with a distance therebetween;

a barrier rib layer between the first substrate and the second substrate;

discharge cells between the first substrate, the second substrate, and within the barrier rib layer;

a phosphor layer within each of the discharge cells;

first electrodes between the first substrate and the second substrate and coupled together at a plurality of first electrode single junctions between the first electrodes along a first direction, each of the first electrodes circumscribing one of the discharge cells, each of the first electrode single junctions having an outer portion that converges toward its center;

second electrodes between the first substrate and the second substrate and apart from the first electrodes along a direction substantially perpendicular to the first substrate and the second substrate and coupled together at a plurality of second electrode single junctions between the second electrodes along the first direction, each of the second electrodes circumscribing one of the discharge cells, each of the second electrode junctions having an outer portion that converges toward its center; and address electrodes apart from the second electrodes along a direction substantially perpendicular to the first substrate and the second substrate and extending in a direction crossing the first direction, wherein each of the address electrodes includes a protruding portion, the protruding portion having an outer contour within to an inner contour of the second electrodes, and wherein the first electrodes and the second electrodes are elliptical rings surrounding their respective discharge cells.

5. The plasma display panel of claim 4, wherein the protruding portion is an elliptical plate having an outer contour of a substantially same shape as an inner contour of a corresponding discharge cell in a cross-sectional plane parallel to a plane of the first substrate.

6. A plasma display panel comprising:

a first substrate and a second substrate substantially parallel to each other with a distance therebetween;

a barrier rib layer between the first substrate and the second substrate;

discharge cells between the first substrate, the second substrate, and within the barrier rib layer;

a phosphor layer within each of the discharge cells;

first electrodes between the first substrate and the second substrate and coupled together at a plurality of first electrode single junctions between the first electrodes along a first direction, each of the first electrodes circumscribing one of the discharge cells, each of the first electrode single junctions having an outer portion that converges toward its center;

second electrodes between the first substrate and the second substrate and apart from the first electrodes along a direction substantially perpendicular to the first substrate and the second substrate and coupled together at a plurality of second electrode single junctions between the second electrodes along the first direction, each of the second electrodes circumscribing one of the discharge cells, each of the second electrode junctions having an outer portion that converges toward its center; and address electrodes apart from the second electrodes along a direction substantially perpendicular to the first substrate and the second substrate and extending in a direction crossing the first direction, wherein each of the address electrodes includes a protruding portion, the protruding portion having an outer contour within to an inner contour of the second electrodes, and wherein the first electrodes and the second electrodes are overlapping circular rings surrounding their respective discharge cells, the first electrodes being above or below the second electrodes.

7. The plasma display panel of claim 6, wherein the protruding portion is a circular plate.

8. The plasma display panel of claim 1, wherein the first electrodes and the second electrodes are overlapping polygonal shaped rings surrounding their respective discharge cells, the first electrodes being above or below the second electrodes in a direction substantially perpendicular to the first substrate.

9. The plasma display panel of claim 8, wherein a cross-sectional shape of the discharge cells in a plane parallel to the first substrate is substantially the same as the polygonal shape of the protruding portion.

10. The plasma display panel of claim 1, wherein the first electrodes and the second electrodes comprise a metallic material.

11. The plasma display panel of claim 1, further comprising an insulating dielectric layer covering the first electrodes and the second electrodes.

12. The plasma display panel of claim 11, further comprising a protective layer covering a surface of the dielectric layer forming an inner surface of the discharge cells.

13. The plasma display panel of claim 1, wherein the address electrodes are over the first substrate, wherein the barrier rib layer is over the address electrodes, and wherein the first electrodes and the second electrodes are between the barrier rib layer and the second substrate.

14. The plasma display panel of claim 1, wherein the discharge cells are cylindrical having a cross-sectional shape in a plane of the first substrate or the second substrate selected among a circle, an ellipse, or a polygon, and wherein a shape of the first electrodes and the second electrodes corresponds to the cross-sectional shape of the discharge cells.

15. A plasma display panel comprising:

a first substrate and a second substrate substantially parallel to the first substrate and apart from the first substrate;

a barrier rib layer between the first substrate and the second substrate and having cylindrical hollow spaces within the barrier rib layer;

discharge cells between the first substrate and the second substrate as upper and lower surfaces of the discharge cell, and walls of the hollow spaces as walls of the discharge cells;

a phosphor layer on the first substrate and over portions of the walls within each of the discharge cells;

ring shaped first electrodes between the first substrate and the second substrate, and coupled together at a plurality of first electrode single junctions between the ring shaped first electrodes along a first direction, each of the first electrodes circumscribing one of the discharge cells, each of the first electrode single junctions having an outer portion that converges toward its center;

ring shaped second electrodes between the first substrate and the second substrate and apart from the first electrodes along a direction substantially perpendicular to the first substrate and the second substrate and coupled together at a plurality of second electrode single junctions between the ring shaped second electrodes along the first direction, each of the second electrodes circumscribing one of the discharge cells, each of the second electrode single junctions having an outer portion that converges toward its center; and address electrodes extending in a direction crossing the first direction and distanced from the second electrodes along a direction substantially perpendicular to the first substrate, wherein each of the address electrodes includes a protruding portion, the protruding portion being a plate having an outer contour within to an inner contour of the second electrodes.

* * * * *